United States Patent [19]

Habernig

[11] Patent Number: 5,054,955

[45] Date of Patent: Oct. 8, 1991

[54] GATE POLE FOR SKI SPORT

[76] Inventor: Reinhold Habernig, Moritschstrasse 5, A-9500 Villach (Karnten), Austria

[21] Appl. No.: 549,939

[22] Filed: Jul. 9, 1990

[51] Int. Cl.[5] ..... E01F 09/00; E04H 17/14

[52] U.S. Cl. ..... 404/10; 256/19

[58] Field of Search ..... 404/10; 256/1, 19; 403/273, 2; 280/820, 809

[56] References Cited

FOREIGN PATENT DOCUMENTS

| | | |
|---|---|---|
| 236435 | 10/1964 | Austria . |
| 357085 | 6/1980 | Austria . |
| 2546327 | 4/1977 | Fed. Rep. of Germany . |
| 2813485 | 10/1978 | Fed. Rep. of Germany . |
| 2922729 | 12/1980 | Fed. Rep. of Germany . |
| 2944565 | 5/1981 | Fed. Rep. of Germany . |
| 3106712 | 9/1982 | Fed. Rep. of Germany . |
| 1482473 | 5/1967 | France . |
| 2174809 | 4/1975 | France . |
| 477602 | 10/1969 | Switzerland . |

*Primary Examiner*—Ramon S. Britts
*Assistant Examiner*—Nancy Connolly
*Attorney, Agent, or Firm*—Young & Thompson

[57] ABSTRACT

A gate pole for ski sport comprises a rigid ground tube (2) and a stand tube (3) extending upwardly from the ground tube (2), this stand tube being fashioned as a tubular, pressurizable, pole-shaped hollow member (12). The lower end (19) of the tubular hollow member (12) consisting of an elastic sheet material, at which end a valve (25) is provided, is accommodated in a rigid sleeve (6) connected with the ground tube (2). The tubular hollow member (12) is surrounded on the outside by a braided hose (10) which is closed (11) at the upper end of the tubular hollow member (12). The tubular hollow member (12) is in contact with the braided hose (10) only if it has been placed under a pressure of 4–8 atmospheres gauge. The gate pole, as contrasted to other air-filled gate poles, has a defined tilting zone without the tilting characteristic being adversely affected.

11 Claims, 1 Drawing Sheet

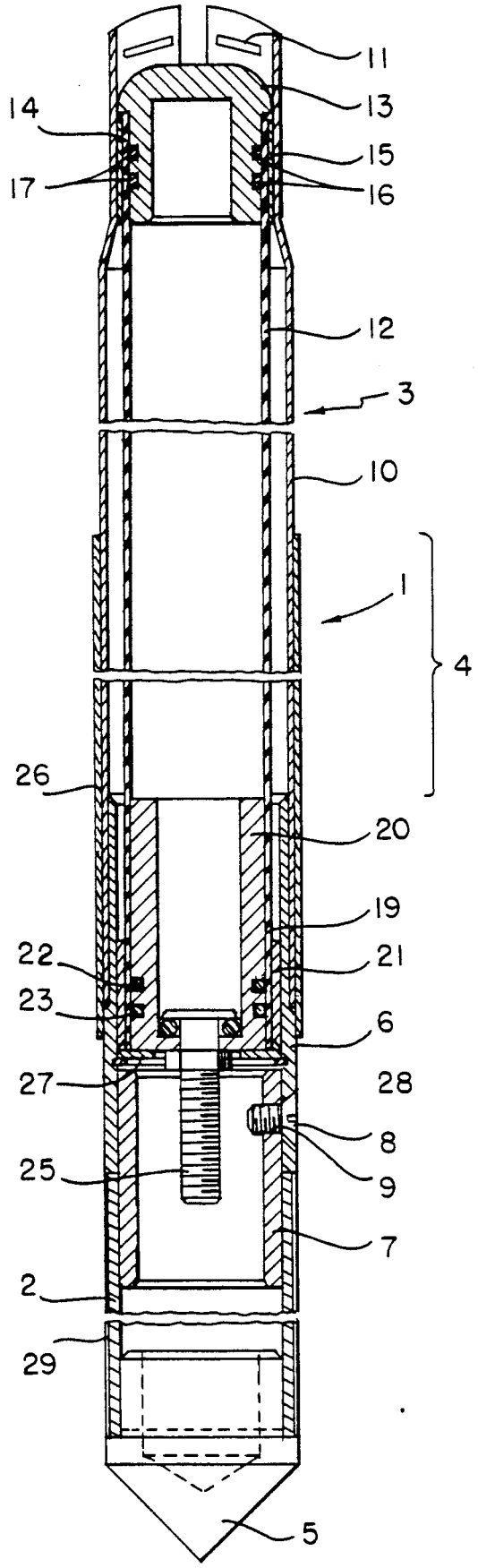
11
13
14
15
17
16
12
3
10
1
4
26
20
19
22
21
23
6
27
28
8
25
9
7
2
29
5

GATE POLE FOR SKI SPORT

The invention relates to a pole, especially a gate pole for ski sport with a rigid ground tube which can be lowered into the ground and/or snow, and with a stand tube extending upwardly from the ground tube and being fashioned as an elastic, tubular, pole-shaped hollow member which can be placed under pressure and which is equipped with a valve for the injection of compressed air.

Beside the conventional slalom poles consisting of wood or a synthetic resin, so-called "tilting poles" are likewise employed as they are known, for example, from French Patent 1,482,473; DOS 3,106,712; DOS 2,944,565, and French Patent 2,174,809. These conventional tilting poles consist of a more or less rigid tube connected to the ground tube via an elastically deformable connecting piece, the ground tube being inserted in the ground and/or the snow.

Furthermore, gate poles for slalom and downhill run have been known which exhibit a pole consisting of a tubular, pressurizable, rod-shaped hollow member. Examples thereof are the gate poles known from Austrian Patent 357,085 and DOS's 2,546,327, 2,813,485 and 2,922,729. The conventional gate poles have the drawback that they do not exhibit a defined zone about which they can be tipped so that uncontrolled movements arise (DOS 2,944,565). Furthermore, in the conventional gate poles, the connection between the stand tube and the ground tube is complicated and/or does not meet the requirements posed in the utilization as a gate pole.

A marker post subdivided into a threaded section to be twisted into the ground and the actual marker post has been known from Swiss Patent 477,602. The marker post can be connected to the threaded section by means of a crossbolt.

Austrian Patent 236,435 discloses a traffic line restriction stake consisting of a pedestal part anchored in the ground and a top part serving as a marker for a tube closed at the top and bottom by stoppers. A bar is provided in the top part which is connected via a cable to a weight displaceable in the pedestal part. On account of the force exerted by the weight which is optionally enhanced by a spring, the top part of the road restriction stake known from Austrian Patent 236,435 automatically rights itself again after an impact.

Starting with a pole, especially a gate pole of the type discussed hereinabove, as also known from DOS 2,546,327, the invention is based on the object of providing an air-filled pole which is of a simple structure and can be easily manufactured, this pole having a defined tilting range.

According to the invention, this object has been attained by providing that the lower end of the tubular hollow member, consisting of an elastic sheet material, at which end the valve is attached, is accommodated in a rigid sleeve connected to the ground tube; and that a braided hose is provided which surrounds the tubular hollow member on the outside and which is closed at the upper end of the tubular hollow member.

Owing to the structure of the pole according to this invention, especially due to the rigid sleeve receiving the lower end section of the tubular hollow member, a defined tilting zone of the pole of this invention is obtained. Moreover, protection of the hollow member from damage is achieved by the braided hose pushed over the tubular hollow member and not fixedly connected to the latter, without impairment of the tilting characteristic of the pole according to the invention. Furthermore, the configuration of the pole according to this invention offers the advantage that the ground tube can be readily disengaged from the sleeve even if the tubular hollow member has been inflated; this considerably facilitates the handling of the pole, particularly its insertion in the snow and/or ground.

In one embodiment of the invention, the provision is made that the braided hose has an internal diameter larger than the outer diameter of the pressureless tubular hollow member, and that the tubular hollow member, placed under a pressure of 4–8 atmospheres gauge, has an external diameter which is equal to the internal diameter of the braided hose. Consequently, the braided hose surrounds the tubular hollow member at a spacing while the tubular hollow member is not pressurized, and the tubular hollow member is in contact with the inner wall of the braided hose only while it is placed under pressure. In this embodiment, the uninflated pole can be collapsed or rolled up in a compact fashion.

In a practical version of the invention, the provision is made that the lower end of the braided hose is joined to the rigid sleeve by cementing and extends over the sleeve on the outside. Thereby the transition between the rigid sleeve and the braided hose supported by the tubular hollow member is particularly advantageous.

In order to additionally protect the critical transitional region between the sleeve and the braided hose and/or the tubular hollow member, the provision can be made within the scope of this invention that a protective hose is arranged in the upper end section of the rigid sleeve, covering the lower end section of the braided hose and being joined, especially by cementing, to the sleeve and/or to the braided hose, at least in the region of the sleeve.

In one embodiment of the invention the provision is made that the lower end of the tubular hollow member carries a sealing plug inserted therein; that the lower end of the tubular hollow member is affixed in an airtight fashion to the outer surface of the sealing plug by cementing, vulcanizing or by a collar surrounding the hollow member on the outside; and that the valve is mounted in the sealing plug. In this version, the tubular hollow member need not be sealed by vulcanizing or the like, and/or joined to the valve, although also this embodiment is within the scope of the invention. In a further embodiment of the invention, the provision can be made that at least two externally open annular grooves, into which sealing rings are inserted, are arranged in the outer surface of the sealing plug, and that the collar is located in the zone of the sealing rings.

In a similar way as the lower end, the upper end of the tubular hollow member can also be sealed by closing the upper end of the tubular hollow member by means of a plug, as known per se, and by fixing the upper end of the tubular hollow member in place in an airtight fashion, by cementing, vulcanizing or by means of a collar, on the outer wall of the plug. Also in this embodiment it is possible, for improving the sealing action, to provide in the zone of the collar at least two annular grooves in the outer wall of the plug in which ring seals are inserted.

Securing the position of the uninflated tubular hollow member in the sleeve in the axial direction of the pole can be effected by retaining the tubular hollow member in the sleeve in the direction of the axis of the latter by means of a ring from the bottom end, this ring, in turn, being secured by a spring ring inserted in an inwardly open annular groove in the rigid sleeve.

Additional details of the invention can be seen from the following description of the drawing showing one embodiment of the invention in an axial sectional view.

A pole 1, serving as a tippable gate pole for ski sport ("slalom pole"), consists of a ground tube 2 and a stand tube 3 wherein the transitional zone between the ground tube 2 and the stand tube 3 constitutes a tilting zone 4.

The ground tube 2, consisting of a metal or a synthetic resin, exhibits on its outside a ribbing 29 fashioned, for example, as a threaded section in order to improve retention in the ground and/or snow. At the lower end of the ground tube 2, the latter is sealed by a plug 5 which has a conical end face.

The stand tube 3 exhibits at its lower end a rigid sleeve 6 which is placed over a pipe section 7 firmly joined to the ground tube 2. The pipe section 7 and the sleeve 6 are connected with each other by at least one fleatheaded screw 8 which latter is threaded into a threaded bore 9 in the pipe section 7.

One end of a braided hose 10 is connected to the sleeve 6; the braided hose is closed off at its upper end by means of stitched darts 11.

A tubular hollow member 12 of an elastic material, for example rubber, is accommodated in the braided hose 10. The tubular hollow member 12 is closed at its upper end by means of a plug 13, the upper end 14 of the tubular hollow member 12 being urged against the plug 13 with the aid of a collar 15. In order to improve the seal, ring gaskets 17 are inserted in outwardly open annular grooves 16 of the plug 13. The plug 13 can consist of a metal or of a synthetic resin (polyvinyl chloride).

The lower end of the tubular hollow member 12 is firmly connected to a sealing plug 20, the lower end 19 of the tubular hollow member 12 being urged by means of a collar 21 against the outer surface of the insert 20. Also the sealing plug 20 exhibits outwardly open annular grooves 22 in which ring gaskets 23 are inserted.

A valve 25 is connected in an airtight fashion with the sealing plug 20; the tubular hollow member 12 can be inflated via this valve. It should be pointed out at this stage that the tubular hollow member is shown in the drawing in the uninflated condition; in this condition, the hollow member has a spacing from the braided hose 10. As soon as the tubular hollow member 12 has been inflated, it comes into contact with the inside of the braided hose 10 and tensions the latter also in its longitudinal direction.

A protective tube 26 of a strong fabric is provided in the region of the tilting zone 4; this protective tube is cemented, in the zone of its section covering the sleeve 6, to the sleeve 6 and/or to the section of the braided hose 10 present at that location. The protective tube 26 serves, on the one hand, for the purpose of protecting the lower, especially endangered region of the braided hose 10 from damage by skiers and the like, and, on the other hand, defines a boundary of the tilting zone 4.

It is understood that the elastically inflatable, tubular hollow member 12 can also be designed in one piece, i.e. without a plug 13 or insert 20. Also, an embodiment of the tubular hollow member 12 is possible wherein the plug 13 and/or the insert 20 are joined to the hollow member 12 by vulcanizing. If the tubular hollow member 12 is made of one piece, then the valve can also be directly joined to one end of the hollow member 12, for example by vulcanizing. In this case, and in the illustrated embodiment, the tubular hollow member is inflated during use of the pole according to this invention with an internal pressure of between 4 and 8 atmospheres gauge.

In the illustrated embodiment—analogously also in case of a one-piece design of the tubular hollow member 12—this hollow member is retained in the sleeve 6 by a supporting disk 27 which latter, in turn, is retained by a spring ring 28 inserted in an annular groove in the inner surface of the sleeve 6.

What I claim is:

1. A pole (1), for use as a gate pole for ski sports comprising, a rigid ground tube (2), a stand tube (3) extending upwardly from the ground tube (2) and having an elastic, tubular, hollow member (12) equipped with a valve (25) at its lower end (19) for the injection of compressed air, said lower end (19) fabricated from an elastic sheet material, and a rigid sleeve that is joined to the ground tube and is accommodating said hollow tubular member (12) within itself, and a braided hose (10) surrounding the tubular hollow member (12) on the outside and closed (11) at the upper end of said tubular hollow member (12).

2. Pole according to claim 1, wherein the braided hose (10) has an internal diameter which is larger than the outer diameter of the pressureless tubular hollow member (12), and that the tubular hollow member (12), placed under a pressure of 4–8 atmospheres gauge, has an external diameter which is equal to the internal diameter of the braided hose (10).

3. Pole according to claim 1, wherein the lower end of the braided hose (10) is joined to the rigid sleeve (6) by cementing and extends over the sleeve on the outside.

4. A pole according to claim 1 wherein there is a protective hose (26) in the upper end section of the rigid sleeve, said hose covering the lower end section of the braided hose (10) and being joined to the sleeve (6) and to the braided hose (10).

5. A pole according to claim 1 wherein there is a protective hose (26) in the upper end section of the rigid sleeve, said hose covering the lower end section of the braided hose (10) and being joined to the sleeve (6) or to the braided hose (10).

6. A pole according to claim 1, wherein a sealing plug (20) having a valve mounted thereon, is inserted in the lower end (19) of the tubular hollow member (12) which is affixed in an airtight fashion to the outer surface of the sealing plug (20) by cementing, or vulcanizing.

7. A pole according to claim 1, wherein the upper end (14) of the tubular hollow member (12) is closed by a plug means (13), and that the upper end (14) of the tubular hollow member (12) is fixed in place on the outer wall of the plug means (13) in an airtight fashion by cementing, vulcanizing, or by collar means (15).

8. Pole according to claim 7, wherein at least two annular grooves (16) are provided in the region of the collar (15) in the outer wall of the plug (13), ring gaskets (17) being inserted in these grooves.

9. Pole according to claim 1, wherein the tubular hollow member (12) is retained in the sleeve (6) in the direction of the axis of the latter by means of a ring (27) from the bottom end, this ring, in turn, being secured by a spring ring (28) inserted in an inwardly open annular groove in the rigid sleeve (6).

10. A pole according to claim 1, wherein a sealing plug (20) having a valve mounted thereon, is inserted in the lower end (19) of the tubular hollow member (12) which is affixed in an airtight fashion to the outer surface of the sealing plug (20) by a collar (21) surrounding the hollow member (12) on the outside.

11. A pole according to claim 10 wherein at least two externally open annular grooves (22), into which sealing rings (23) are inserted, are arranged in the outer surface of the sealing plug (20), and the collar (21) is located within the region defined by the sealing rings.

* * * * *